US005806124A

United States Patent [19]

Schneider et al.

[11] Patent Number: 5,806,124

[45] Date of Patent: Sep. 15, 1998

[54] APPARATUS FOR CLEANING VINYL BILLBOARDS AND FLEX FACES

[76] Inventors: David Price Schneider; David Wayne McCleary, both of 15561 Product La., Huntington Beach, Calif. 92649

[21] Appl. No.: 855,464

[22] Filed: May 13, 1997

[51] Int. Cl.[6] ..... A47L 25/00

[52] U.S. Cl. ..... 15/88.3; 15/77

[58] Field of Search ..... 15/77, 88.1, 88.2, 15/88.3

[56] References Cited

U.S. PATENT DOCUMENTS

| | | | |
|---|---|---|---|
| 3,792,503 | 2/1974 | Brock | 15/77 |
| 3,886,769 | 6/1975 | Conti . | |
| 4,095,443 | 6/1978 | Hasselschwert . | |
| 4,401,476 | 8/1983 | Klaiber . | |
| 4,453,386 | 6/1984 | Wilkins . | |
| 4,708,452 | 11/1987 | Schoen | 15/77 |
| 4,890,550 | 1/1990 | Eriksson et al. . | |
| 4,894,095 | 1/1990 | Schramm et al. . | |
| 5,477,584 | 12/1995 | Thumm | 15/77 |
| 5,528,788 | 6/1996 | Yamamoto et al. | 15/88.3 |
| 5,607,534 | 3/1997 | Kawanishi et al. | 15/77 |
| 5,694,657 | 12/1997 | Yoshida et al. | 15/88.3 |

OTHER PUBLICATIONS

"Metromedia Technologies, International" brochures Outdoor Advertising Trade Show, Atlanta, Georgia, Oct. 2–5, 1996.

*Primary Examiner*—Terrence Till

*Attorney, Agent, or Firm*—Lewis M. Brande; Thomas A. McCleary

[57] ABSTRACT

An apparatus for cleaning and recycling used vinyl billboards and flex faces by attaching the used media to a series of endless belts which transport the used billboard through a chemical bath. A chemical solution is dispensed on the painted surfaces of the billboard using a series of spray nozzles, then brushes remove the remaining paint and simultaneously polish the used surface. The used solvent containing the dissolved paints is cleaned and recycled for reuse.

5 Claims, 14 Drawing Sheets

APPARATUS FOR CLEANING VINYL BILLBOARDS AND FLEX FACES

BACKGROUND OF THE INVENTION

Recycling vinyl material coated with paint has been a recurrent problem, particularly for vinyl billboards and flex faces used in the advertising industry. Historically, cleaning vinyl billboards and flex faces was done by hand, if at all. The processes and solvents previously used would damage the underlying vinyl, making such a process unsuitable for reusing the vinyl billboards or flex faces, as well as being cost prohibitive. Consequently, many advertisers would discard or store used billboards and flex faces. Due to the toxicity of vinyl plastic waste material, finding a suitable means for disposing of used billboards and flex faces poses an environmental risk.

Accordingly, there is a strong need in the industry for a device that is capable of cleaning vinyl billboards and flex faces efficiently and cost effectively.

SUMMARY OF THE INVENTION

The present invention offers a solution to the aforementioned problems. The present invention is an apparatus for the removal of paint from vinyl surfaces in a continuous manner by guiding a vinyl billboard through a washing tank. A first spray header containing a series of spray nozzles mounted in the washing tank first sprays a low pressure mist of solvent, that begins dissolving the existing paint on the surface of the billboard. While the solvent is in the process of softening the paint and prior to the evaporation of the solvent, the vinyl billboard passes over a second spray header containing a series of nozzles. The softened paint is removed from the vinyl billboard by a high pressure stream of solvent from this second series of nozzles. The vinyl billboard is then passed between a guide roller and a circular polishing brush. The circular polishing brush rotates due to a second motor, that is independent from the motor powering the drive roller. The circular polishing brush abrades the surface of the vinyl billboard and removes any remaining paint that was not removed from the action of the first two sets of spray nozzles. A third spray header containing a series of spray nozzles provides a high pressure stream of solvent that cleans the bristles of the circular polishing brush without damaging the vinyl substrate.

The vinyl billboard next moves to a rinsing basin which contains a fourth spray header with a set of spray nozzles. These spray nozzles use a low pressure stream of clean solvent which eliminates any streaks from paint that might remain from the washing process. Then the vinyl billboard is guided into a vertical position with the cleaned surface facing away from the apparatus and the opposing side of the billboard moves by a panel that is mounted to the rear of the apparatus. This allows for any final cleaning that might be necessary. The vinyl billboard is then guided to a position where the vinyl billboard is removed from the apparatus and prepared for shipping. As a consequence, this method allows used vinyl billboards to be recycled and reused primarily by advertisers rather than either storing the used billboard, or discarding the used billboard.

BRIEF DESCRIPTION OF THE DRAWINGS

FIG. 11 is taken through the grooves of the guide rollers and drive rollers, and corresponds to the number of grooves and endless belts that the apparatus is set up to use.

DETAILED DESCRIPTION

Figure 1:
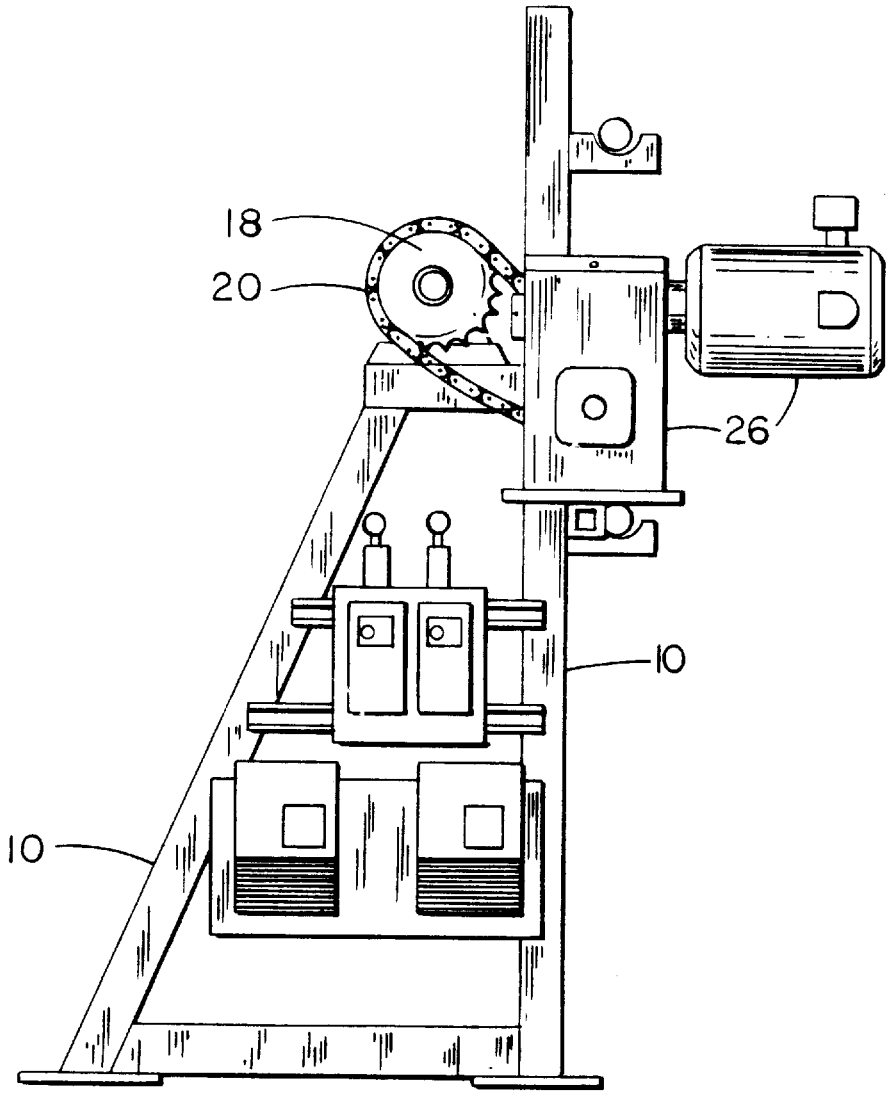
FIG. 1 is a left side elevation view showing the first support structure, the motor, the chain and the toothed gear driving the drive roller.
Figure 2:
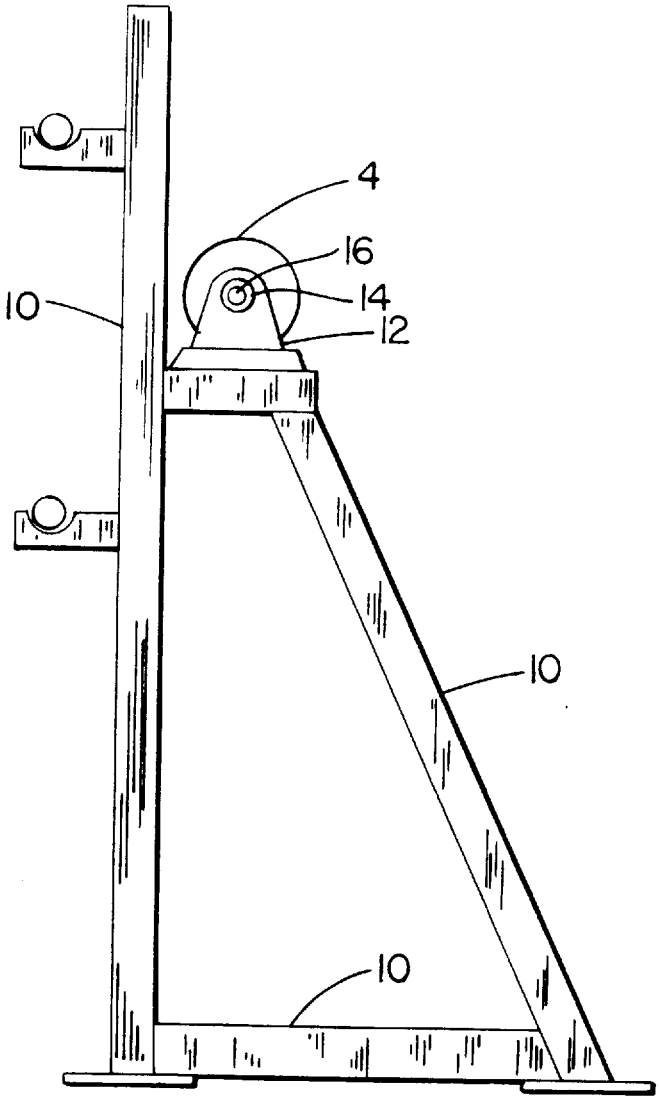
FIG. 2 is a right side elevation view showing the first support structure, and the drive roller.
Figure 3:
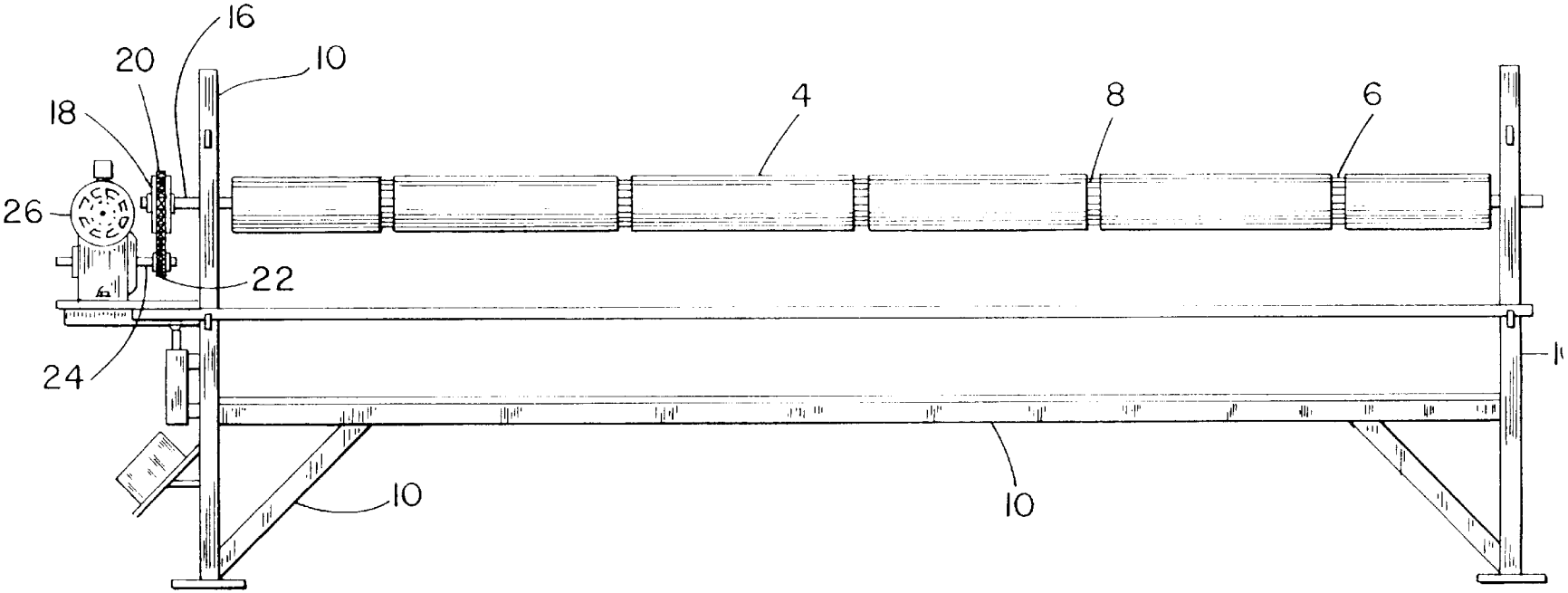
FIG. 3 is a front elevation showing the relationship of the first support structure, the drive roller the motor the chain and the toothed gear.
Figure 4:
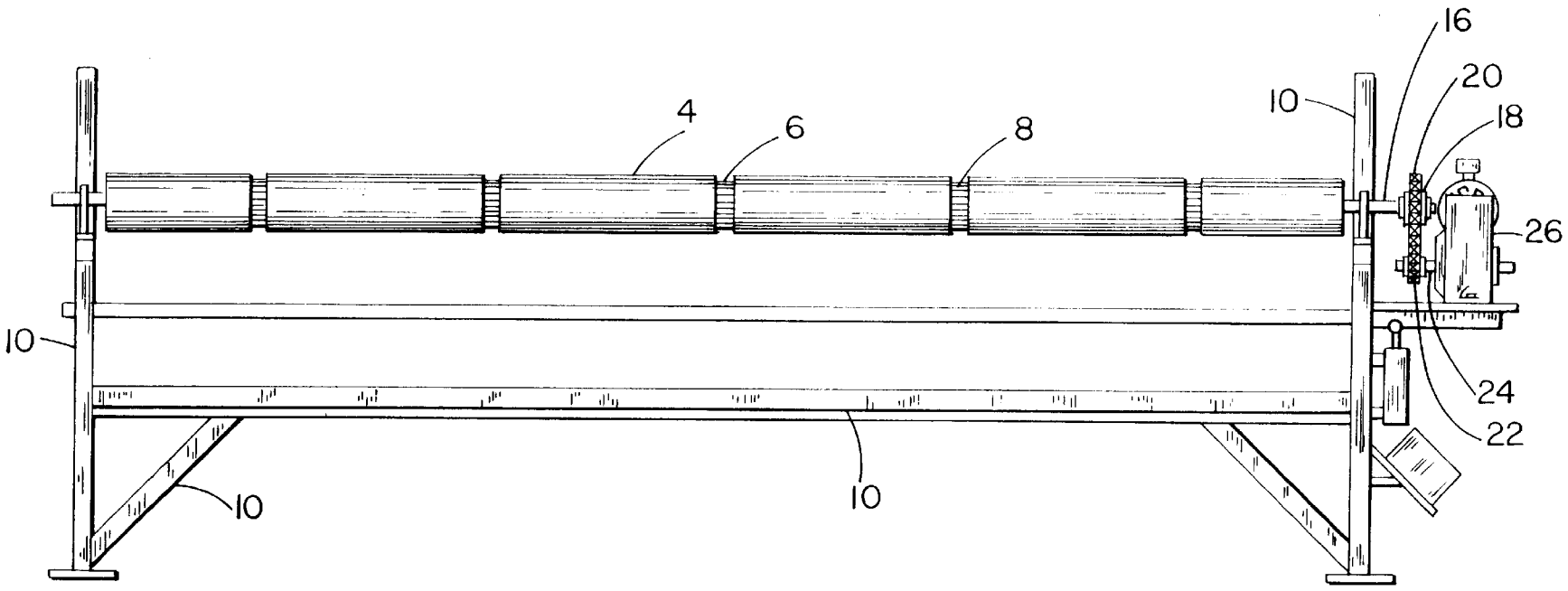
FIG. 4 is a rear elevation looking towards the front of the apparatus.
Figure 5:
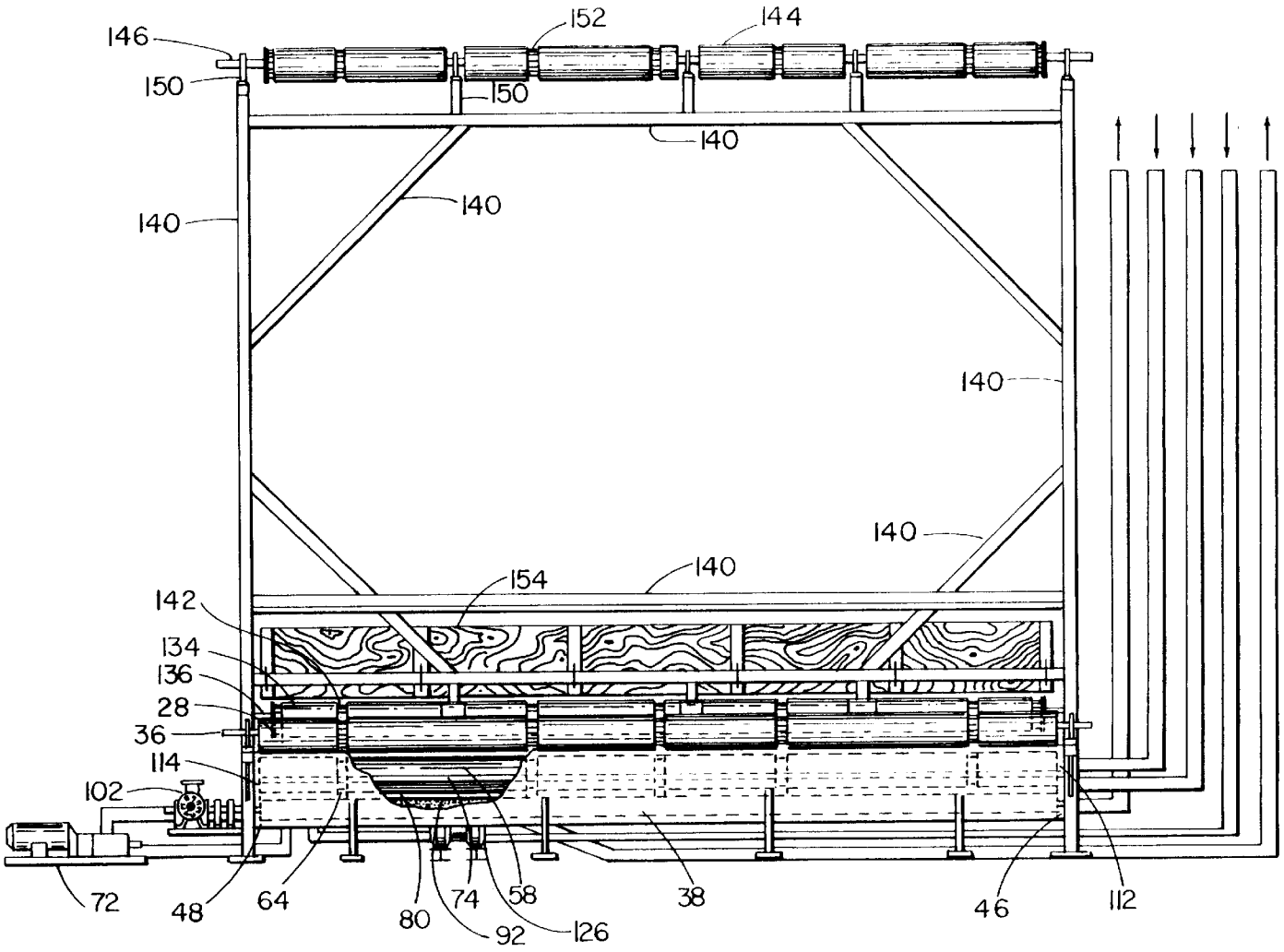
FIG. 5 is a front elevation looking towards the rear of the apparatus showing the second support structure, the vertical uprights, the first, second, and the third guide roller, the washing tank, the motor to drive the circular polishing brush, the backing panel, piping for the solvent, and a motor to drive the circular polishing brush.
Figure 6:
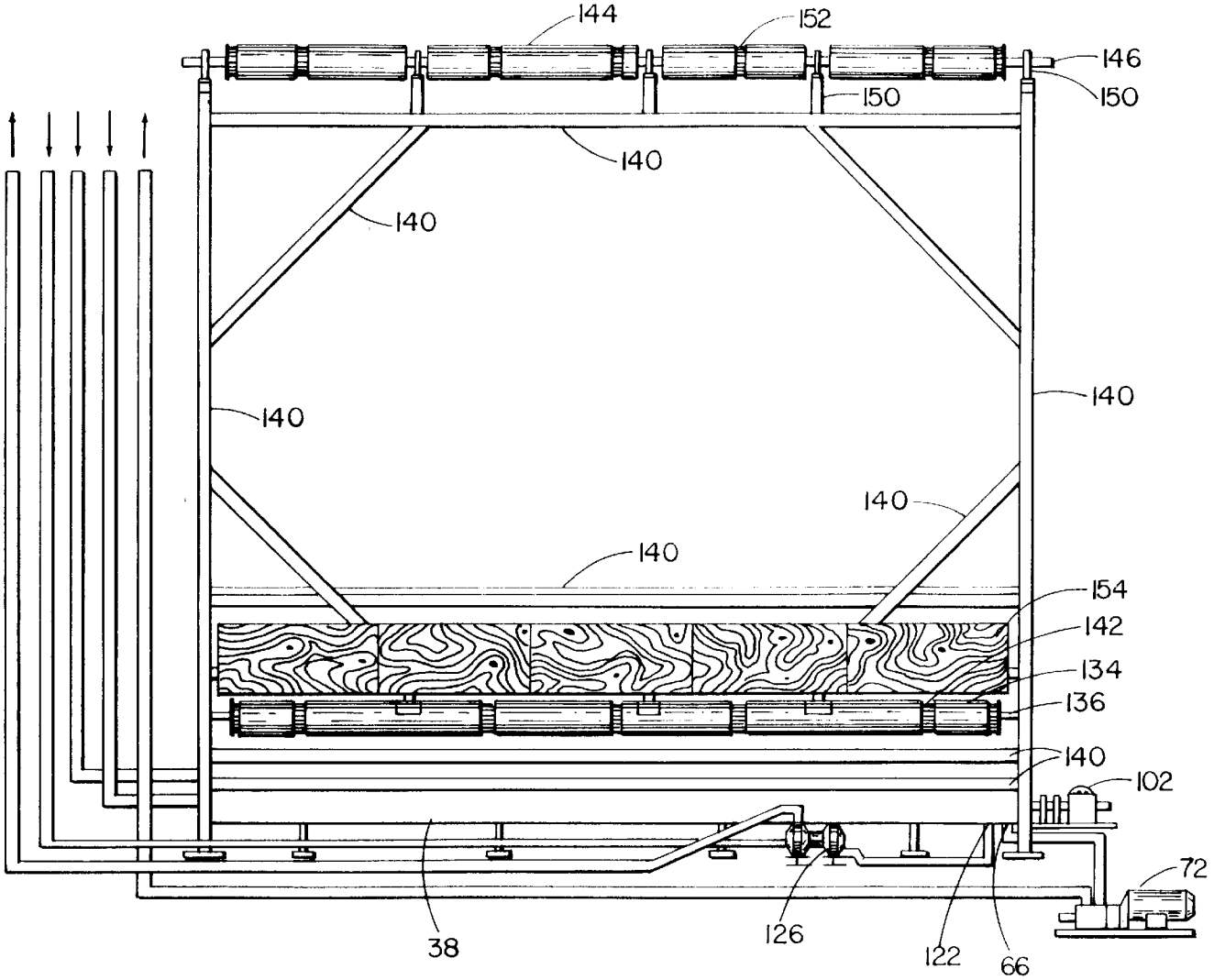
FIG. 6 is an front elevation looking at the rear of the apparatus showing the second support structure, the vertical supports, guide rollers 3 and 4, and the backing plate.
Figure 7:
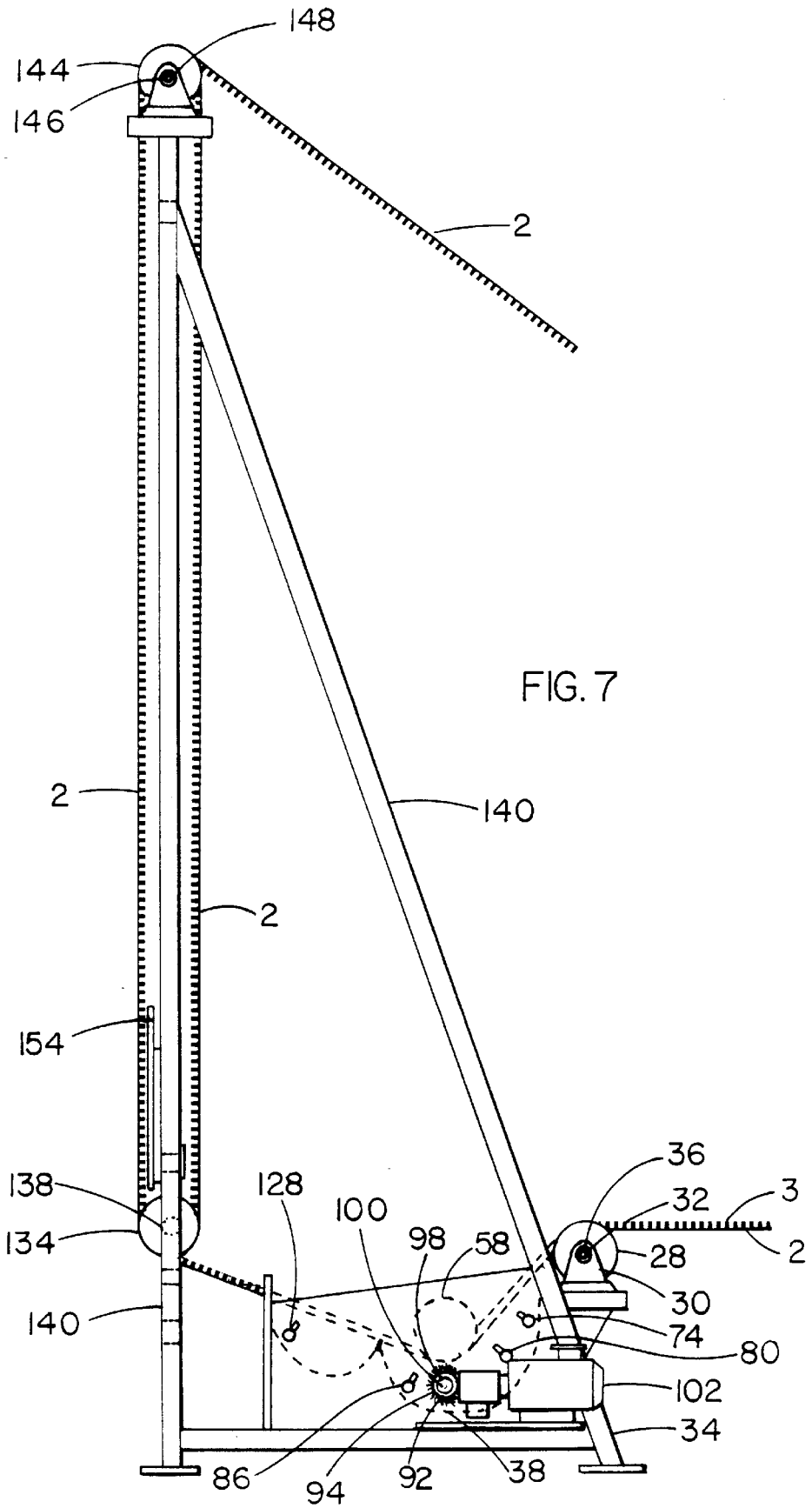
FIG. 7 is an elevation looking at the left side of the second support structure depicting the relationship of the components mounted to the second support structure, and showing the washing tank, the rinsing basin, guide rollers 1, 2, 3, and 4, the vertical supports, an endless belt, and spray headers 1, 2, 3, and 4.
Figure 8:
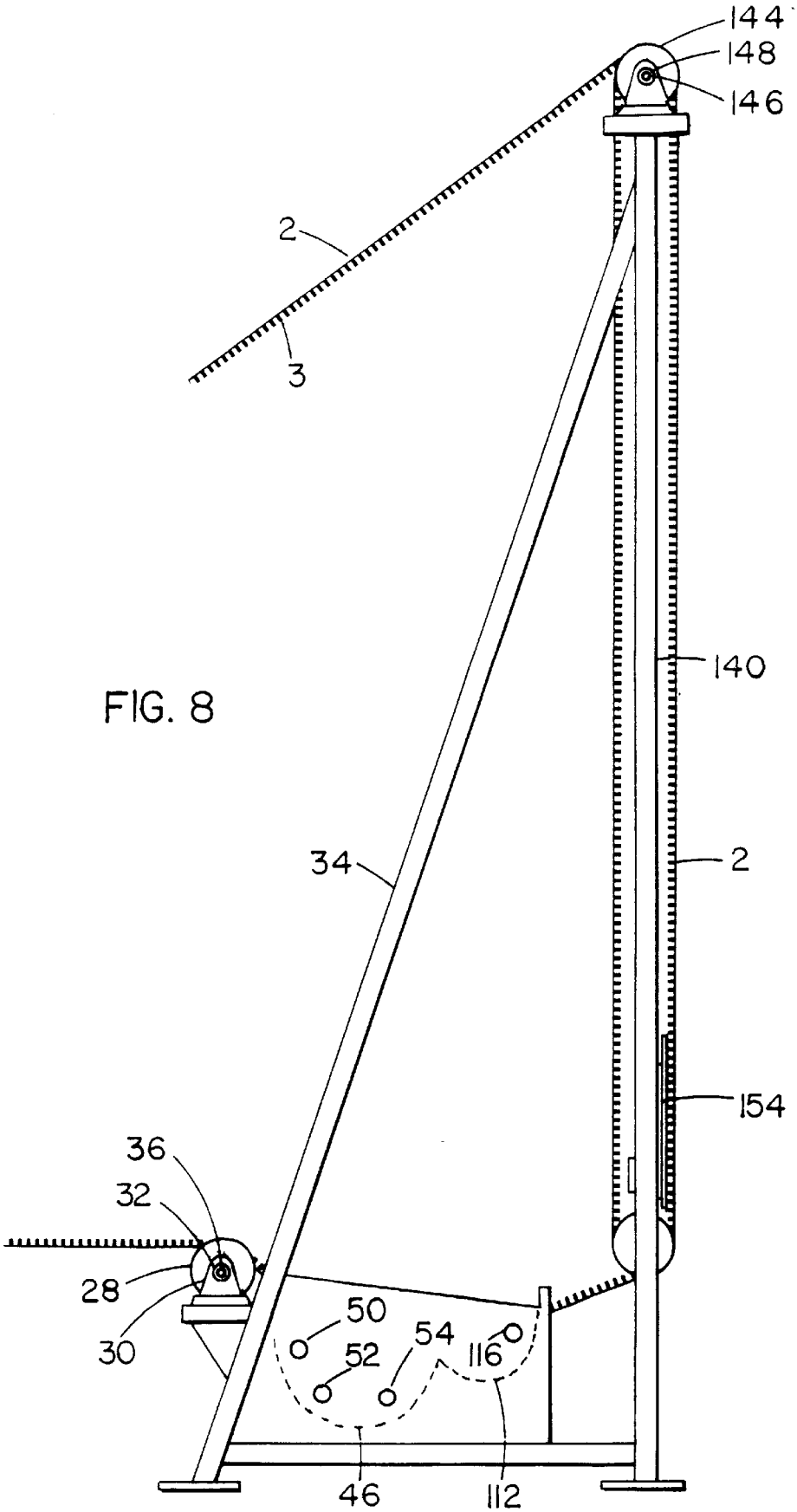
FIG. 8 is an elevation looking at the right side of the apparatus showing the second support structure, the holes in the washing tank and the rinsing basin for the spray headers, the endless belt and the first guide roller.
Figure 9:
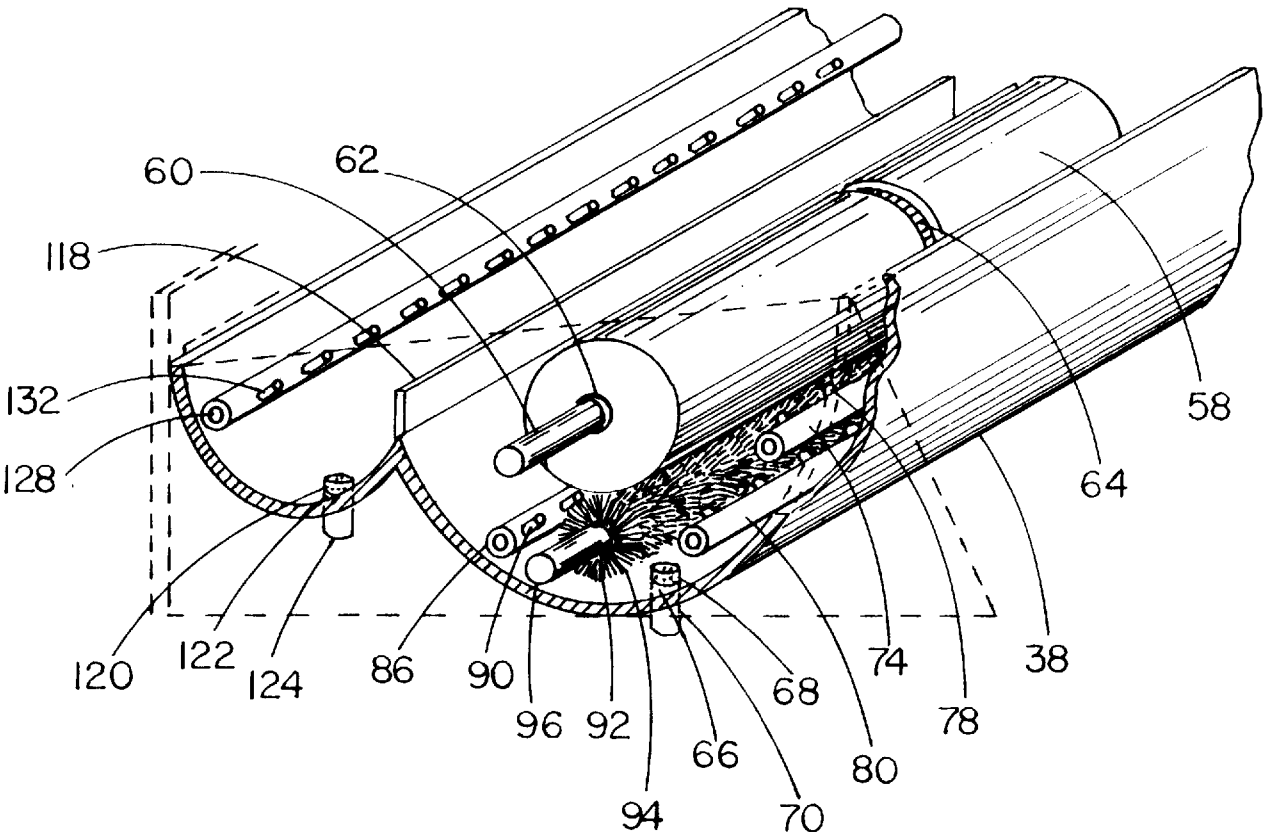
FIG. 9 is an elevation depicting a perspective view showing an end of the washing tank and the rinsing basin transparent in order to view the spray headers and the orientation of the spray nozzles that are mounted on the spray headers, the circular polishing brush, the drains and the filters mounted in the washing tank, and the rinsing basin, and the second guide roller.
Figure 10:
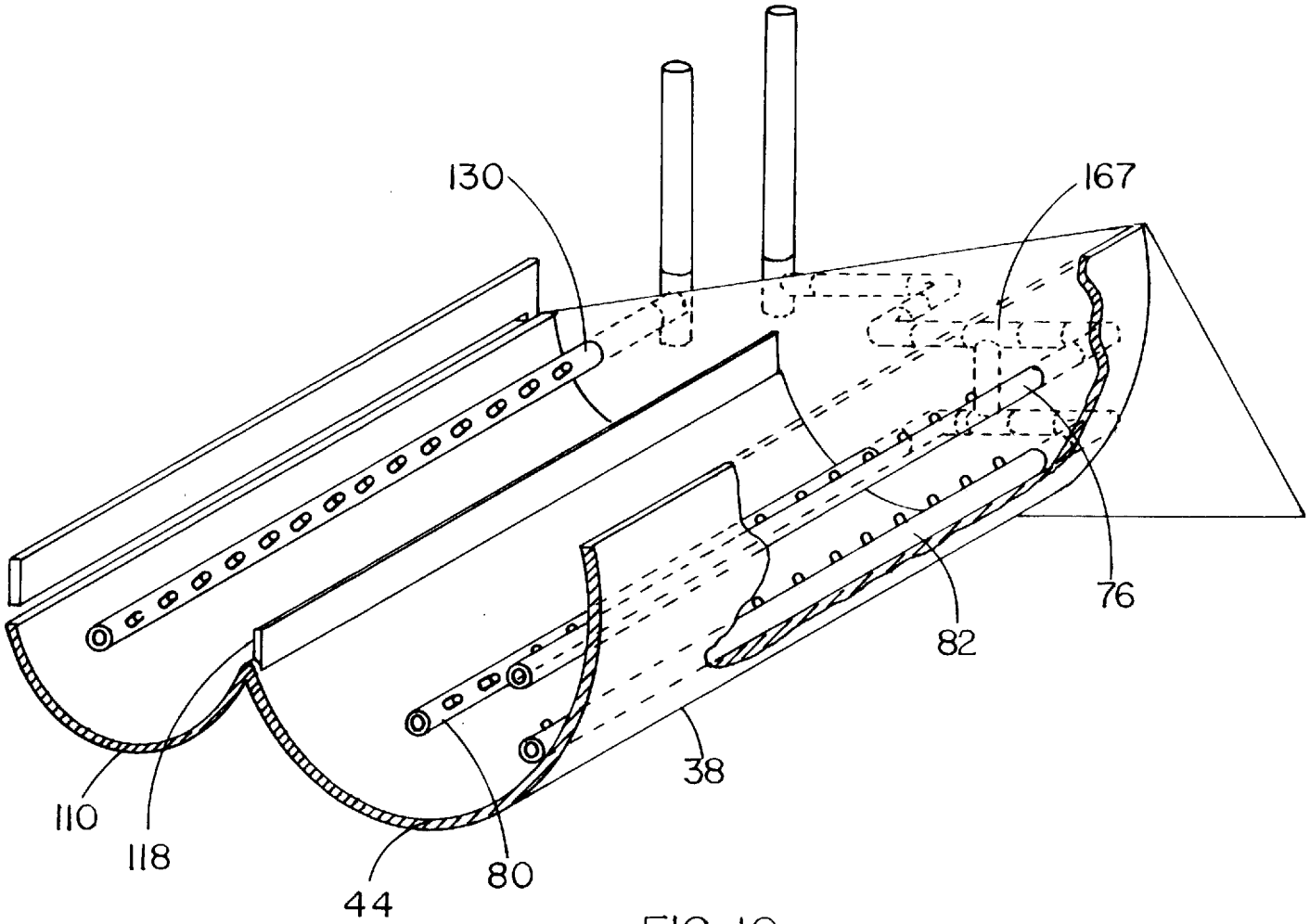
FIG. 10 is an elevation depicting a perspective view looking towards the second end of the washing tank and the rinsing basin, showing the positions of spray headers 1, 2, 3, and 4, the inlets of the respective spray headers.
Figure 11:
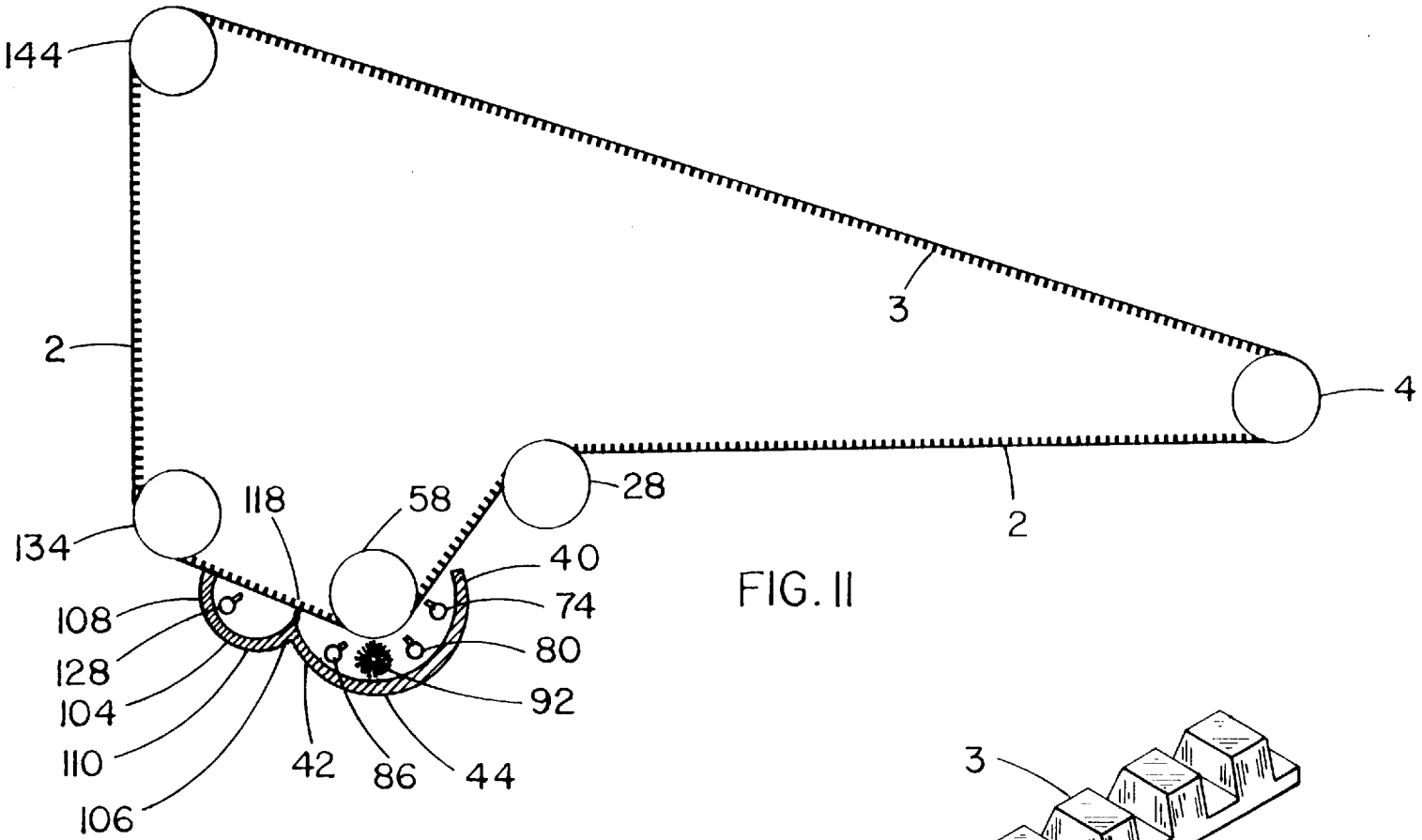
FIG. 11 is a cross sectional view of the apparatus showing the relative positions of the major components. The drive roller, the guide rollers, the washing tank, the rinsing basin, the spray headers, an endless belt, and the circular polishing brush.
Figure 12:
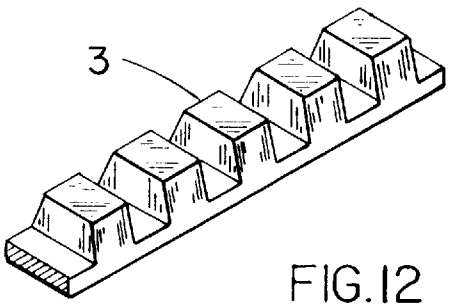
FIG. 12 is an elevation showing a perspective view of an endless belt showing the teeth.
Figure 13:
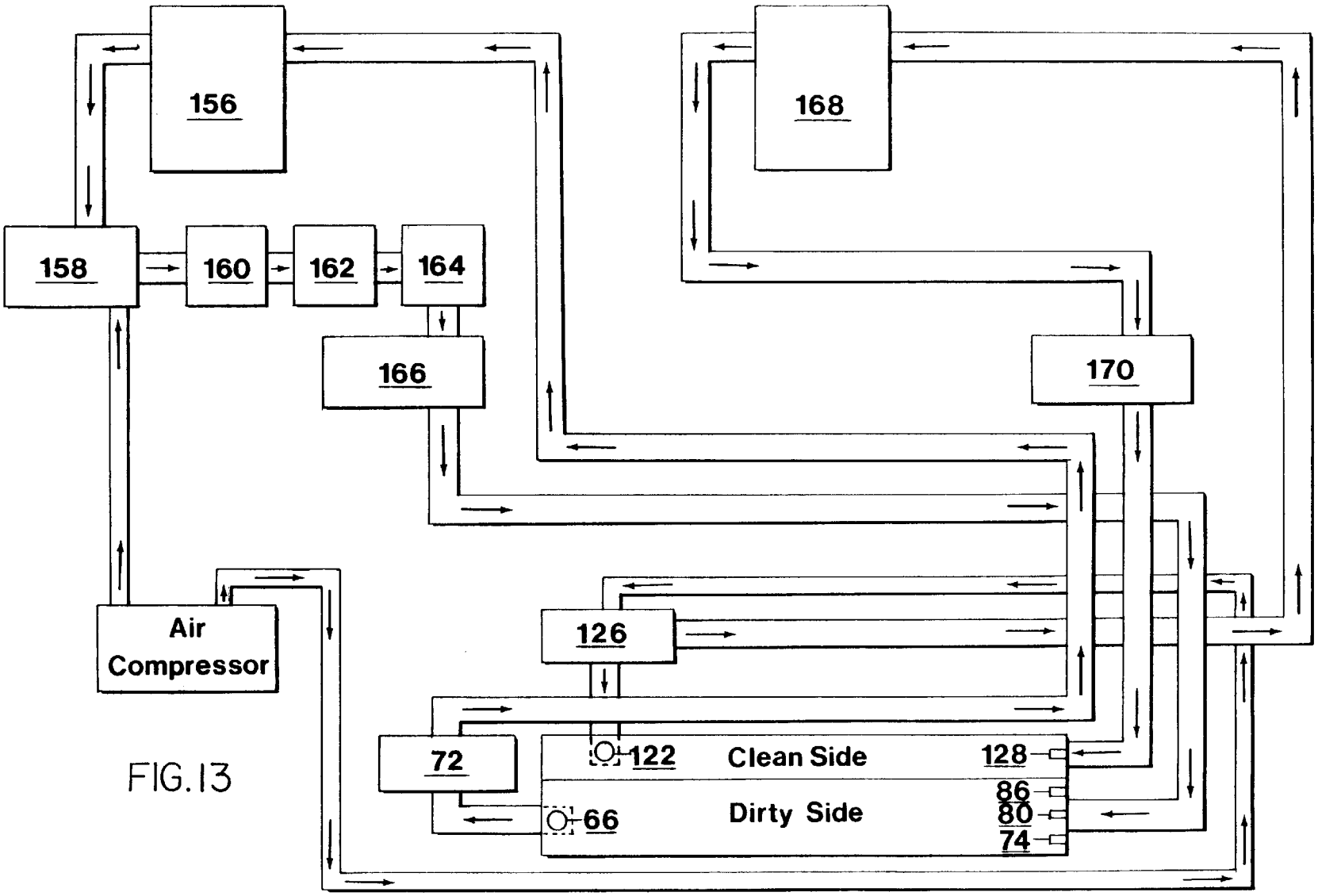
FIG. 13 is a flow schematic showing one embodiment for recycling the used solvent drained from the washing tank and the rinsing basin.
Figure 14:
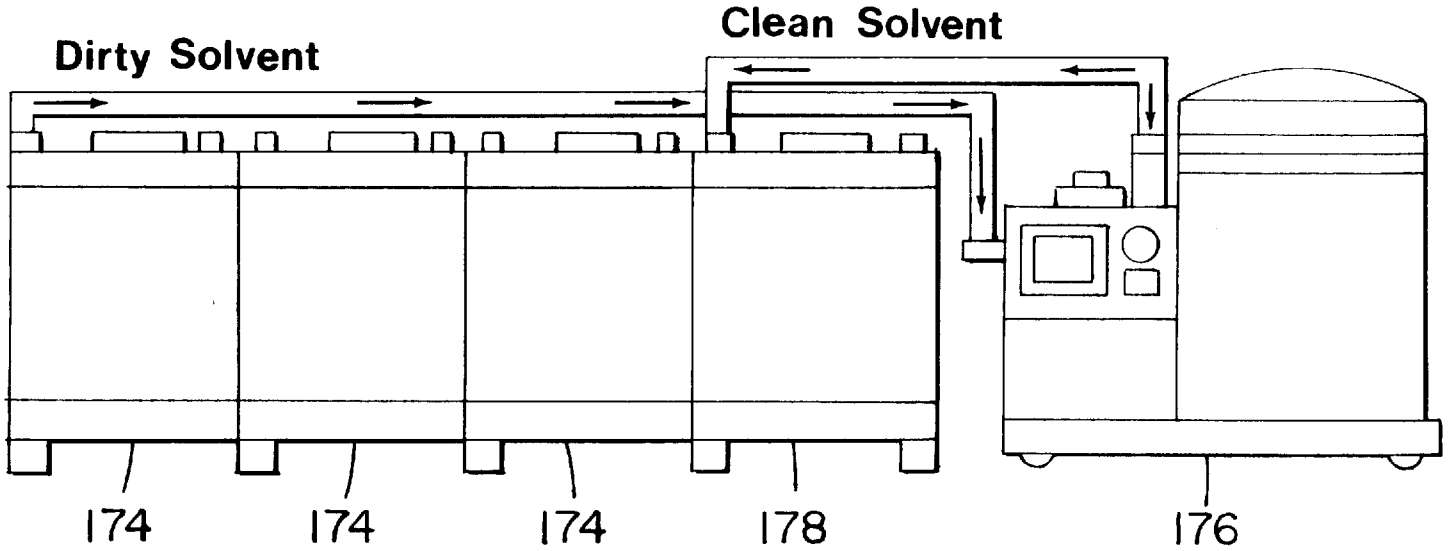
FIG. 14 is a schemation of the preferred embodiment of the means for recycling the used solvent.
Figure 15:
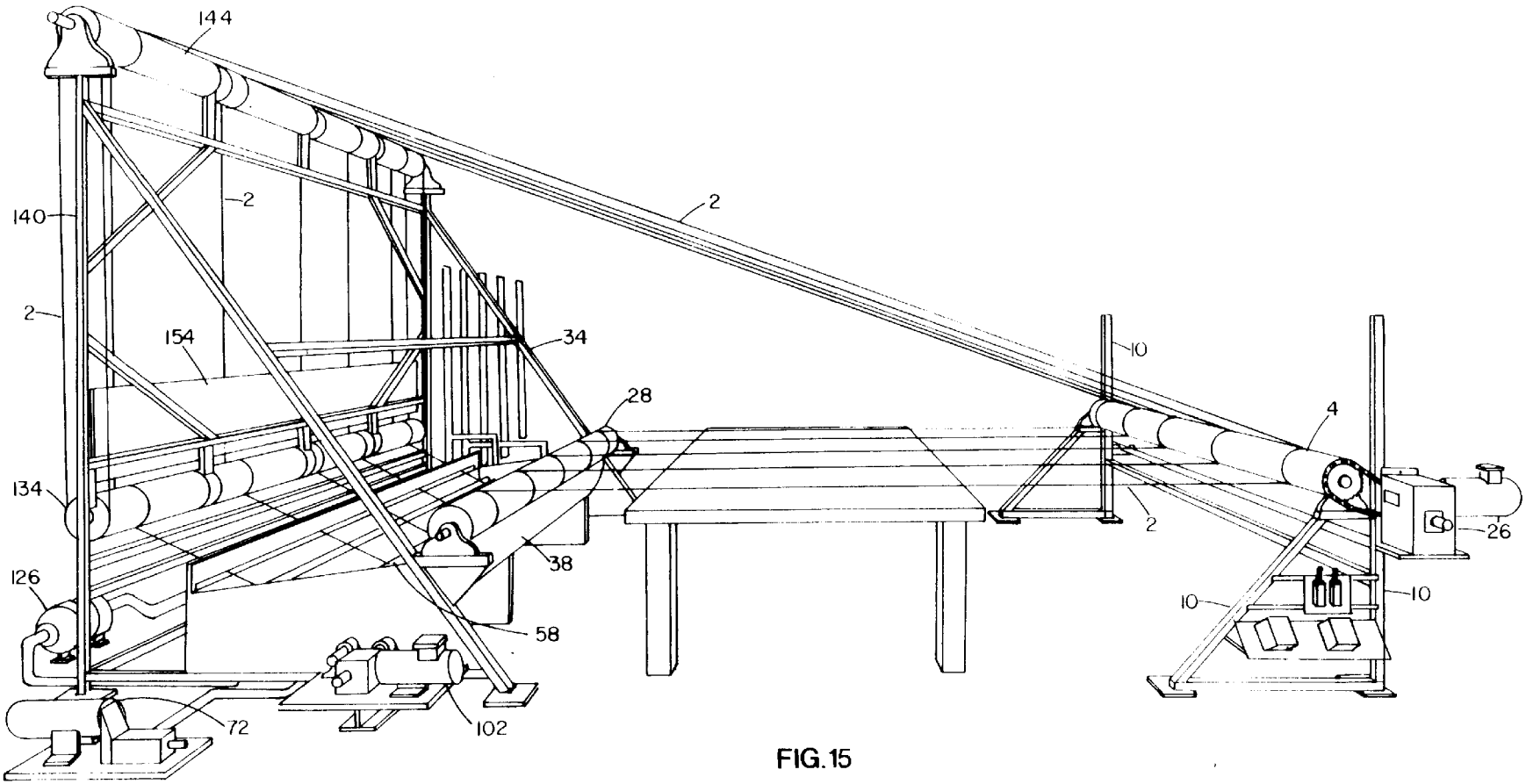
FIG. 15 is a perspective view of the entire apparatus.

While the invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

This embodiment of the invention contains a plurality of endless belts (2), each having a thickness, a smooth side and an opposing, toothed side (3). A drive roller (4) which has a smooth surface, and contains a plurality of grooves (6) thereon, each groove containing a set of teeth (8) complementary to each set of teeth in the plurality of endless belts (2). The teeth (3) on the plurality of endless belts (2) engage the teeth (8) contained in the plurality of grooves (6) on the drive roller. Each groove (6) on the drive roller (4) also has a depth that is about the same as the thickness of each of the endless belts (2) that engage the teeth (3) therein, and the smooth side of the plurality of endless belts (2) provide a continuous surface for a media (such as a vinyl billboard or flex face) to ride upon.

A first support structure (10) made of suitable structural members such as box beams, has opposing side supports (12), and each side support has a bearing (14) mounted thereon. The drive roller (4) has an axis, the axis being disposed in a direction transverse to a direction of movement of the endless belts (2). A shaft (16) is mounted longitudinally through the axis of the drive roller (4) and is rotatably supported on each end of the shaft (16) by the bearings (14) mounted on the side supports (12). An end of the shaft has a toothed gear (18) affixed thereon, which engages a chain (20). The chain (20) attaches to a second toothed gear (22) which is affixed to a shaft (24) on a first motor (26). The first motor (26) provides a torque through the chain (20) to rotatably move the drive roller (4) which drives the plurality of endless belts (2) in a forward motion. The media to be cleaned is attached to the plurality of endless belts (2) to stretch the media in the direction of movement of the endless belts (2), which prevents wrinkling as the media is carried through the apparatus.

The media is then carried over a first guide roller (28). The first guide roller (28) has an axis, the axis being disposed in a direction transverse to the direction of motion of the endless belts (2), and is mounted to side supports (30), with the side supports (30) opposing each other and each side support (30) having a bearing (32) mounted thereon. The side supports (30) are attached to a second support structure (34) made of suitable structural members, such as box beams. The first guide roller (28) has a shaft (36) that penetrates longitudinally through the axis of the first guide roller (28), is affixed to the first guide roller (28) and is rotationally supported at each end of the shaft (36) by a bearing (32) mounted on each of the side supports (30). The first guide roller (28) has a smooth exterior surface. The media is gripped frictionally between the smooth exterior surface of the first guide roller (28) and the smooth side of the plurality of endless belts (2) thus guiding the media to be cleaned towards a washing tank (38). The first guide roller (28) is located outside the washing tank (38).

The washing tank (38) is mounted to the second support structure (34), has an open top, a first side (40) and a second side (42), the second side (42) opposite the first side (40), with both sides curved concavely downward and joined at a bottom (44), thereby allowing used solvent to collect in the bottom (44) of the washing tank (38). The washing tank (38) also has a first end (46) and a second end (48), the first end (46) opposite the second end (48) and each end attached to the first side (40) and the second side (42) of the washing tank (38). The first end (46)of the washing tank (38) further containing a first hole (50), a second hole (52) and a third hole (54). The second end (48) of the washing tank (38) contains a fourth hole (56).

A second guide roller (58) located inside the washing tank (38) has an axis, the axis being disposed in a direction transverse to the direction of the movement of the endless belts (2). The second guide roller (58) has a shaft (60) affixed longitudinally through the axis, and is rotatably attached to a set of bearings (62), each bearing being located at an end of the shaft (60) of the second guide roller (58) which allows the second guide roller (58) to rotate about its axis. The second guide roller (58) has a plurality of grooves (64), the number of grooves matching the number of endless belts (2), which allow the plurality of endless belts (2) to be guided therein. Each groove (64) on the second guide roller (58) has a depth that is about the same as each of the plurality of endless belts (2) that ride therein. The smooth side of the plurality of endless belts (2) filling the grooves (64) of the second guide roller (58) provides a continuous surface for the media to ride upon. The first guide roller (28) and the second guide roller (58), in conjunction with the plurality of endless belts (2), provide a tensile force between the first guide roller (28) and the second guide roller (58), to stretch the media being cleaned, which will prevent wrinkles while the media is being sprayed with a solvent.

The solvent typically used here consists essentially of methylisobutyl ketone (MIBK), ethanol, toluene and acetone in approximately equal parts. Other suitable solvent mixtures, however, may be used as the working solvent.

The washing tank (38) is sloped toward the second end (48), defining a low end containing an exit drain (66) and a filter (68). The exit drain (66) allows the solvent, rich with paint, to pass through the filter (68) and through the exit drain (66) into a pipe (70) leading to a return pump 1 (72). The washing tank (38) has a spray header 1 (74), having opposing ends. The opposing ends of spray header 1 are attached to the first end (46) and the second end (48) of the washing tank (38). Spray header 1 (74) has an inlet (76) at one end which penetrates through the first hole (50) in the first end (46) of the washing tank (38) for the introduction of fresh solvent from a recycling station. Spray header 1 (74) has a plurality of spray nozzles (78) mounted on spray header 1 (74) and the plurality of spray nozzles (78) dispense clean solvent onto the media to be cleaned. A spray header 2 (80) has opposing ends. The opposing ends of spray header 2 (80) are attached to the first end (46) and the second end (48) of the washing tank (38). Spray header 2 (80) has an inlet (82) at one end which penetrates through the second hole (52) in the first end (46) of the washing tank (38) for the introduction of fresh solvent from a recycling station. Spray header 2 (80) has a plurality of spray nozzles (84) mounted on spray header 2 (80) and the plurality of spray nozzles (84) dispense clean solvent onto the media to be cleaned. A spray header 3 (86) has opposing ends. The opposing ends of spray header 3 (86) are attached to the first end (46) and the second end (48) of the washing tank (38). Spray header 3 (86) has an inlet (88) at one end which penetrates through the third hole (54) in the first end (46) of the washing tank (38) for the introduction of fresh solvent from a recycling station. The spray header 3 (86) has a plurality of spray nozzles (90) mounted on spray header 3(86) and the plurality of spray nozzles (90) dispense clean solvent onto the media to be cleaned. Spray header 1 (74) and spray header 2 (80) are located between the first guide roller (28) and the second guide roller (58). Spray header 2 (80) is located between spray header 1(74) and the second guide roller (58). Spray header 1 (74) and spray header 2 (80) have their respective nozzles (78) and (84) oriented so as to impact the media surface to be cleaned. The nozzles (78) mounted on spray header 1 (74) provide a low pressure mist of clean solvent, that has low velocity, and softens the paint on the media. The nozzles mounted on spray header 2 (80) provides a high pressure stream of clean solvent, at high velocity, which impacts the media containing the paint and removes the paint as a result of the force of the impact from the high pressure stream, and from the softening of the paint from the low pressure mist. The distance between spray header 1 (74)

and spray header 2 (80) is gauged to allow sufficient time for the low pressure mist of solvent from spray header 1 (74) to soften the paint, prior to the high pressure stream from spray header 2 (80) impacts the media, removing the softened paint.

The media then is guided to pass between the second guide roller (58) and a circular polishing brush (92). The circular polishing brush (92) has helically arranged bristles (94), the bristles (94) being soft and chemically resistant to the solvent. The circular polishing brush (92) has a longitudinal axis, the longitudinal axis being disposed in a direction transverse to the direction of movement of the plurality of endless belts (2). A shaft (96) is positioned through the longitudinal axis of the circular polishing brush (92) and is fixed therein. A set of bearings (98), one of each bearing (98) being mounted on the first end (46) and the second end (48) of the washing tank (38), rotatably mount the shaft (96) to the opposing ends of the washing tank (38). An end (100) of the shaft (96) of the circular polishing brush (92) is attached to a second motor (102), the second motor (102) being independent from the aforementioned first motor (26), which is attached to the drive roller (4). The action of the helically arranged bristles (94) of the circular polishing brush (92) against the media removes any paint on the surface of the media remaining after the high pressure stream from spray header 2 (80) is applied, and prepares the surface of the media for reuse with fresh paint.

Spray header 3 (86) is mounted after the second guide roller (58) and has a plurality of spray nozzles (90) mounted thereon. The plurality of spray nozzles (68) are oriented towards an interface. The interface is defined as being the junction between the media being cleaned and the helical bristles (94) of the circular polishing brush (92). The nozzles (90) mounted on spray header 3 (86) provide a high pressure stream of clean solvent at high velocity, which impacts the circular polishing brush (92) and the media being cleaned at the aforementioned interface, cleaning the circular polishing brush (92) as well as the media due to the force of the impact from the high pressure stream of solvent.

The media is then guided from the washing basin (38) into a rinsing basin (104). The rinsing basin (104) is mounted to the second support structure (34), has an open top, a first side (106) and a second side (108) curved concave downward to form a bottom (110), a first end (112) and a second end (114). The first end (112) of the rinsing basin (104) having a hole defined thereon. The rinsing basin (104) is positioned behind the washing tank (38) and is sloped at the second end (114) which defines a low end, and allows the used solvent to accumulate at the low end. A rubber seal (118) mounted on a forward edge of the rinsing basin separates the rinsing basin (104) from the washing tank (38). The used solvent passes through a filter (120) and an exit drain (122) mounted in the low end of the rinsing basin (104). The solvent removed from the rinsing basin (104) may be reused without cleaning, as only small amounts of paint are dissolved from the media into the rinsing basin. A drain pipe (124) is attached to the exit drain (122), and carries the used solvent to a return pump 2 (126).

The rinsing basin (104) contains a spray header 4 (128). Spray header 4 (128) has opposing ends and is attached to the first end (112) and the second end (114) of the rinsing basin (104). Spray header 4 (128) has an inlet (130) at one end, which penetrates the hole in the first end (112) of the rinsing basin (104), for the introduction of fresh solvent from a recycling station and has a plurality of spray nozzles (132) affixed thereon, the spray nozzles (132) being oriented to strike the media surface at low velocity and low pressure. Spray header 4 (128) provides a final wash for removing any paint residue or pigmentation streaks that might remain from the washing process.

The media is then guided by a third guide roller (134) into a vertical position where the cleaned surface of the media faces exterior to the second support structure (34). The third guide roller (134) has an axis, the axis being disposed in a direction transverse to the direction of motion of the plurality of endless belts (2). The third (134) guide roller has a shaft (136) running through its axis and is rotatably supported by a set of bearings (138), one bearing (138) at each end of said shaft. A pair of opposing vertical side supports (140) are attached to the second support structure (34). Each of the bearings (138) are mounted to one of the opposing vertical support structure (140).

The third (134) guide roller has a plurality of grooves (142), the number of grooves (142) matching the number of the plurality of endless belts (2) thus allowing the plurality of endless belts (2) to be guided therein. Each of the plurality of grooves (142) defined within the third (134) guide roller has a depth that is about the same as the thickness of each of the plurality of endless belts (2) that ride therein, and provide a continuous surface for the media to ride upon.

A fourth guide roller (144) has an axis, the axis being disposed in a direction transverse to the direction of motion of the plurality of endless belts (2). The fourth guide roller (144) has a shaft (146) running through the axis and is rotatably supported by a plurality of bearings (148), one bearing mounted at each of a plurality of vertical supports (150). The plurality of vertical supports (150) are attached to the second support structure (34).

The fourth guide roller (144) has a plurality of grooves (152), the number of grooves (152) matching the number of the plurality of endless belts (2) thus allowing the plurality of endless belts (2) to be guided therein. Each of the plurality of grooves (152) defined within the fourth guide roller (144) has a depth that is about the same as the thickness of each of the plurality of endless belts (2) that ride therein, and provide a continuous surface for the media to ride upon. The fourth guide roller (144) is mounted above the third guide roller (134). The third guide roller (134) and the fourth guide roller (144) in conjunction with the plurality of endless belts (2) provide a tensile force to the cleaned media which prevents wrinkling. A backing panel (154) mounted to the vertical supports on the second support structure (34) provides support for the media, allowing for any additional cleaning if necessary.

The media then is guided between the fourth guide roller (144) and the drive roller (4) where the cleaned and polished media is removed from the apparatus and prepared for shipping.

The grooves in the drive roller (6), the second guide roller (58), the third guide roller (134) and the fourth guide roller (144) are positioned to allow the plurality of endless belts (2) to move in paths that are parallel to each other and at the same linear rate relative to each other. This relationship provides a smooth motion of the media through the apparatus and prevents any wrinkling of the media in the direction transverse to the motion of the plurality of endless belts (2).

A first embodiment of recycling station 1 and recycling station 2 are described as follows:

Return pump 1 (72) removes the solvent through the drain (66) in the washing tank (38), and is sent to a surge tank 1 (156) where the solvent rich with paint is drawn off the upper third of surge tank 1 (156) to feed a filter boost pump 1 (158). Filter boost 1 pump (158) provides hydraulic pressure to overcome any pressure drop in filter 1 (160), filter 2 (162), or filter 3 (164). Filter 1 (160) is a sock type filter that is set up to remove gross sized particles. Filter 2 (162) is a sock type filter that is set up to remove fine sized particles. Filter 3 (164) is a sock type filter that is set up to remove extremely fine sized particles. Essentially lean solvent leaves filter 3 (164) to a scrubber lean solvent pump 1 (166). Scrubber lean solvent pump 1 (166) provides the work to deliver the desired lean solvent flows and pressure for the spray nozzles (78),(84),(90) mounted on spray header 1 (74), spray header 2 (80), and spray header 3 (86) through the respective inlets (76),(82),(88), the inlets being mounted to a manifold (167), the manifold attached to the wash tank (38) at one end and scrubber lean solvent pump 1 (166) at the other end, with the spray headers 1,2 and 3 (74),(80)(86) mounted on the wash tank (38).

Return pump 2 (126) removes the solvent through the exit drain (122) in the rinsing basin (104), and is sent to a storage tank (168) where the solvent is stored and then fed to a scrubber lean solvent pump 2 (170). Scrubber lean solvent pump 2 (170) provides the work to deliver the desired clean solvent flows and pressure for the spray nozzles (132) mounted on spray header 4 (128) through the inlet (130) located in the rinsing basin.

A second preferred embodiment of recycling station 1 and recycling station 2 are described as follows:

Return pump 1 (72) removes the solvent through the exit drain (66) in the washing tank (38) and is then sent through the drain pipe (70) to a commercial solvent distillation removal means (172) for recycling the solvent rich with paint. The solvent rich with paint is stored in a plurality of dirty solvent tanks (174), and subsequently distilled in a distillation vat (176) and then stored in a clean solvent tank (178) for reuse. Scrubber lean solvent pump 1 (166) provides the work to deliver the desired lean solvent flows and pressure for the spray nozzles (78) mounted on spray header 1 (74), the spray nozzles (84) mounted on spray header 2 (80), and the spray nozzles (90) mounted on spray header 3 (86).

Return pump 2 (126) removes the solvent through the exit drain (122) in the rinsing basin (104), and is then sent through the drain pipe (124) to a storage tank (168) where the solvent is stored and then fed to a scrubber lean solvent pump 2 (170). Scrubber lean solvent pump 2 (170) provides the work to deliver the desired clean solvent flow and pressure for the spray nozzles (132) mounted on spray header 4 (128) through the inlet (130) located in the rinsing basin (104).

The foregoing descriptions and drawings merely explain and illustrate the invention. The invention is not limited thereto, except insofar as the appended claims are so limited, as those skilled in the art who have the disclosures before them will be able to make modification and variations therein without departing from the spirit and scope of the inventions.

What is claimed is:

1. An apparatus for cleaning vinyl billboards and flex faces comprising:

a) a first support structure;

b) a drive roller, said drive roller being driven by a first motor means, said drive roller and said first motor means being mounted to said first support structure;

c) a transport means for transporting a media to be cleaned, said transport means being propelled by said drive means, said transport means further being directed into a washing tank by a guide roller means, said washing tank having an open top, a first end and a second end, said first end having three circular inlet holes defined therein, concavely curved sloping sides forming a bottom thereby allowing a solvent to accumulate, said second end being positioned lower than said first end, and directing said solvent that has accumulated at said bottom of said washing tank towards a first filter, said solvent passing through said first filter and into a first exit drain at said bottom of said washing tank, said washing tank being mounted to a second support structure, said guide roller means further directing said transport means into a rinsing basin, said rinsing basin having an open top, a first end and a second end, said first end having a circular inlet hole defined therein, concavely curved sloping sides forming a bottom thereby allowing said solvent to accumulate, said second being positioned lower than said first end, and directing said solvent to a second filter, said solvent passing through said second filter and into a second exit drain at said bottom of said rinsing basin, said rinsing basin also being mounted to said second support structure said transport means then being directed by said guide roller means out from said rinsing basin and towards said drive roller;

d) a first spray header having an inlet at one end, said inlet of said first spray header penetrating one of said three holes in said first end of said washing tank and being affixed to said washing tank, said first spray header further having a plurality of spray nozzles attached to said first spray header, said plurality of spray nozzles being oriented to direct solvent towards said media to be cleaned;

e) a second spray header having an inlet at one end said inlet of said second spray header penetrating one of said three holes in said first end of said washing tank and being affixed to said washing tank, said second spray header further having a plurality of spray nozzles attached to said second spray header, said plurality of spray nozzles being oriented to direct solvent towards said media to be cleaned;

f) a circular polishing brush having a set of soft, solvent resistant bristles mounted thereon and a shaft, said shaft having a first and a second end and being positioned through a longitudinal axis of said circular polishing brush and further being rotatably attached to a bearing attached to said first end and said second end of said washing tank, said second end of said washing tank further having a hole defined therein allowing said shaft of said circular polishing brush to penetrate said second end of said washing tank;

g) a second motor means, said second motor means rotatably driving said circular polishing brush;

h) a third spray header having an inlet at one end said inlet of said third spray header penetrating one of said three holes in said first end of said washing tank and also being affixed to said washing tank, said third spray header further having a plurality of spray nozzles attached to said third spray header, said plurality of spray nozzles being oriented to direct solvent towards said media to be cleaned;

i) a fourth spray header having an inlet at one end said inlet of said fourth spray header penetrating one of said hole in said first end of said rinsing basin and being affixed to said rinsing basin, said fourth spray header further having a plurality of spray nozzles, said spray nozzles attached to said fourth spray header, said plurality of spray nozzles being oriented to direct solvent towards said media to be cleaned;

j) a first pump means to provide pressurized clean solvent to said first spray header, said second spray header, and said third spray header located in said washing tank;

k) a second pump means to provide pressurized clean solvent to said fourth spray header located in said rinsing basin; and l) a recycling means to recycle used solvent.

2. An apparatus for cleaning vinyl billboards and flex faces as defined in claim 1, wherein:

a) said drive roller further comprises a smooth outer surface, said smooth outer surface containing a plurality of grooves defined thereon, said grooves each having a set of teeth defined therein;

b) a drive roller shaft mounted through a longitudinal axis of said drive roller, said drive roller shaft being rotatably supported at each end of said drive roller shaft by a bearing mounted on each of a pair of side supports which is attached to said first support structure; and c) said first motor means 1 rotatably turning said drive roller in a direction transverse to the longitudinal axis of said drive roller.

3. An apparatus for cleaning vinyl billboards and flex faces as defined in claim 2, wherein:

a) said transport means comprises a plurality of endless belts, each of said endless belts having a thickness, an upper smooth side, and an opposing toothed side, said plurality of endless belt's opposing toothed side engaging said set of teeth in said plurality of grooves in said drive roller.

4. An apparatus for cleaning vinyl billboards and flex faces as defined in claim 3, wherein:

a) said guide roller means consists of a plurality of guide rollers said plurality of guide rollers consisting of a first guide roller, said first guide roller having a smooth outer surface and a first guide roller shaft, said first guide roller shaft being disposed through a longitudinal axis of said first guide roller and said first guide roller shaft being rotatably supported at each end by a bearing mounted upon a pair of opposing side supports each of which is attached to said second support structure;

b) a second guide roller having a longitudinal axis, and a smooth outer surface, said smooth outer surface of said second guide roller further containing a plurality of grooves thereon, each groove having a depth the same as said thickness of said plurality of endless belts, allowing the plurality of endless belts to engage said grooves therein, said smooth side of said endless belts in conjunction with said smooth outer surface of said second guide roller provide a smooth surface for the media to ride upon, a second drive roller shaft, said second guide roller shaft being disposed through said longitudinal axis of said second guide roller, and said second guide roller shaft being rotatably supported at each end by a bearing mounted to said first end and said second end of said washing tank;

c) a third guide roller having a longitudinal axis and a smooth outer surface, said smooth outer surface of said third guide roller further containing a plurality of grooves thereon, each groove having a depth the same as said thickness of said plurality of endless belts, allowing the plurality of endless belts to engage said grooves therein, said smooth side of said endless belts in conjunction with said smooth outer surface of said third guide roller provide a smooth surface for the media to ride upon, and a third drive roller shaft, said third guide roller shaft being disposed through said longitudinal axis of said third guide roller, said third guide roller shaft being rotatably supported at each end by a bearing mounted to said second support structure;

d) a fourth guide roller having a longitudinal axis, and a smooth outer surface, said smooth outer surface of said fourth guide roller further containing a plurality of grooves thereon, each groove having a depth the same as said thickness of said plurality of endless belts, allowing the plurality of endless belts to engage said grooves therein, said smooth side of said endless belts in conjunction with said smooth outer surface of said fourth guide roller provide a smooth surface for the media to ride upon, and a fourth drive roller shaft, said fourth guide roller shaft being disposed through said longitudinal axis of said fourth guide roller said third guide roller shaft being disposed through said longitudinal axis of said third guide roller, said fourth guide roller shaft being rotatably supported at each end by a bearing mounted to a pair of opposing vertical supports, said opposing vertical supports being attached to said second support structure, said fourth guide roller being located above said third guide roller.

5. An apparatus for cleaning vinyl billboards and flex faces as defined in claim 1, wherein said recycling means comprises:

a) a plurality of solvent tanks for storing used solvent, a commercial solvent distillation means, at least one storage tank for storing distilled solvent, means for introducing used solvent from said solvent tank to said commercial solvent distillation means, means for removing said distilled solvent from said commercial solvent distillation means to said storage tank means for connecting said storage tank and said first pump means, to allow the solvent to flow therethrough.

* * * * *